US005875963A

United States Patent [19]

Stone et al.

[11] Patent Number: 5,875,963

[45] Date of Patent: Mar. 2, 1999

[54] FLIP-TOP RECLOSABLE CONTAINER WITH INTEGRALLY FORMED COLLAR

[75] Inventors: James L. Stone, Grand Rapids; Thomas J. Brink, Kentwood, both of Mich.

[73] Assignee: Tenneco Packaging, Evanston, Ill.

[21] Appl. No.: 841,128

[22] Filed: Apr. 29, 1997

[51] Int. Cl.[6] ..... B65D 5/06

[52] U.S. Cl. ..... 229/225; 229/145; 229/226; 229/277; 493/128; 493/162

[58] Field of Search ..... 229/141, 144, 229/145, 154, 223–227, 905; 493/128–132, 162, 167–174, 183

[56] References Cited

U.S. PATENT DOCUMENTS

| | | | |
|---|---|---|---|
| Re. 26,471 | 10/1968 | Meyers . | |
| 2,348,377 | 5/1944 | Goodyear . | |
| 2,367,476 | 1/1945 | Tyrseck et al. . | |
| 2,369,387 | 2/1945 | Williamson et al. . | |
| 2,369,392 | 2/1945 | Ringler . | |
| 2,396,310 | 3/1946 | Yungblut . | |
| 2,403,698 | 7/1946 | Williamson et al. . | |
| 2,502,117 | 3/1950 | Anderson . | |
| 2,717,074 | 9/1955 | Williamson et al. . | |
| 2,836,343 | 5/1958 | Will . | |
| 2,881,967 | 4/1959 | Ringler . | |
| 2,951,627 | 9/1960 | Wenzel . | |
| 3,140,809 | 7/1964 | Hickin et al. . | |
| 3,207,416 | 9/1965 | Koltz et al. . | |
| 3,345,918 | 10/1967 | Simeone . | |
| 3,355,995 | 12/1967 | Borkmann et al. . | |
| 3,432,090 | 3/1969 | Engel . | |
| 3,524,581 | 8/1970 | Buttery . | |
| 3,708,108 | 1/1973 | Rosenberg, Jr. . | |
| 3,756,501 | 9/1973 | Skillen et al. . | |
| 3,910,486 | 10/1975 | Stone . | |
| 3,963,173 | 6/1976 | Stone . | |
| 4,048,052 | 9/1977 | Tolaas . | |
| 4,083,455 | 4/1978 | Keating, Jr. . | |
| 4,102,457 | 7/1978 | Meyers . | |
| 4,127,229 | 11/1978 | Roccaforte . | |
| 4,141,449 | 2/1979 | Stone . | |
| 4,284,193 | 8/1981 | Roccaforte . | |
| 4,289,239 | 9/1981 | Meyers . | |
| 4,314,643 | 2/1982 | Forbes, Jr. . | |
| 4,531,669 | 7/1985 | Osborne . | |
| 4,542,847 | 9/1985 | Lindstrom . | |
| 4,551,125 | 11/1985 | Pezzana et al. | 493/217 |
| 4,679,694 | 7/1987 | Donohie et al. . | |
| 4,688,677 | 8/1987 | Roccaforte . | |
| 4,726,471 | 2/1988 | Whately et al. . | |
| 4,732,315 | 3/1988 | Gunn | 229/125.09 |
| 4,768,703 | 9/1988 | Sosler et al. | 229/123.1 |

(List continued on next page.)

FOREIGN PATENT DOCUMENTS

| | | |
|---|---|---|
| 1017728 | 9/1977 | Canada . |
| 1323608 | 10/1993 | Canada . |
| 2229996 A | 10/1990 | United Kingdom . |

*Primary Examiner*—Gary E. Elkins
*Attorney, Agent, or Firm*—Arnold White & Durkee

[57] ABSTRACT

A flip-top reclosable carton is comprised of an outer carton and an internal collar. The outer carton includes opposing top and bottom walls, opposing front and back walls, and opposing first and second side walls. The first and second side walls and the front wall include a continuous horizontal tear means for opening up the carton from a sealed form to form a lid hingedly connected to a base. The top wall includes first and second top minor flaps hingedly connected to upper ends of the respective first and second side walls. The internal collar is integrally formed with the first and second top minor flaps. The collar is disposed within the carton and includes a front panel and opposing first and second side panels adjacent to the respective front wall and the opposing first and second side walls of the carton. The collar includes at least one hinged portion and at least one island portion disposed in forcibly displaceable mutual engagement such that opening the lid exerts a force which disengages the mutual engagement and closing the lid leads to snap re-engagement of the hinged portion and the island portion.

21 Claims, 13 Drawing Sheets

U.S. PATENT DOCUMENTS

| | | | |
|---|---|---|---|
| 4,773,542 | 9/1988 | Schillinger et al. . | |
| 4,913,693 | 4/1990 | Ball et al. | 493/194 |
| 4,948,038 | 8/1990 | Moeller | 229/146 |
| 4,987,420 | 1/1991 | Gunn et al. . | |
| 5,092,516 | 3/1992 | Kastanek | 229/226 |
| 5,129,875 | 7/1992 | Chaygneaud-Dupuy | 493/335 |
| 5,148,973 | 9/1992 | Zimmermann | 229/125.28 |
| 5,154,343 | 10/1992 | Stone | 229/225 |
| 5,161,734 | 11/1992 | Ruehl et al. | 229/227 |
| 5,209,394 | 5/1993 | Griffiths et al. | 229/225 |
| 5,215,248 | 6/1993 | Moser . | |
| 5,219,089 | 6/1993 | Kiolbasa et al. . | |
| 5,236,123 | 8/1993 | Stone et al. | 229/225 |
| 5,238,179 | 8/1993 | Hart | 229/117.13 |
| 5,265,799 | 11/1993 | Stone | 229/225 |
| 5,277,360 | 1/1994 | DeMott | 229/122 |
| 5,299,732 | 4/1994 | Armor et al. | 229/117.25 |
| 5,314,114 | 5/1994 | Stone | 229/225 |
| 5,320,279 | 6/1994 | Giblin et al. | 229/225 |
| 5,322,215 | 6/1994 | Roccaforte | 229/225 |
| 5,328,091 | 7/1994 | Koss | 229/231 |
| 5,373,960 | 12/1994 | Gunn et al. . | |
| 5,439,133 | 8/1995 | Stone . | |
| 5,505,374 | 4/1996 | Stone | 229/227 |
| 5,515,996 | 5/1996 | Stone | 229/224 |
| 5,551,938 | 9/1996 | Stone | 493/96 |
| 5,673,849 | 10/1997 | Stone | 229/227 |
| 5,725,144 | 3/1998 | Stone et al. | 229/101 |
| 5,743,462 | 4/1998 | Stone | 229/227 |
| 5,775,576 | 7/1998 | Stone | 229/225 |

FLIP-TOP RECLOSABLE CONTAINER WITH INTEGRALLY FORMED COLLAR

FIELD OF THE INVENTION

The present invention relates generally to flip-top reclosable paperboard containers and, more particularly, relates to a flip-top reclosable container having an internal collar integrally formed with the top minor flaps of the container.

BACKGROUND OF THE INVENTION

One type of flip-top reclosable container is a two-piece structure having an outer carton and a separately formed internal collar or liner. The outer carton generally includes opposing top and bottom walls, opposing front and back walls, and opposing first and second side walls. The first and second side walls and the front wall include a continuous horizontal tear strip for opening up the carton from a sealed form to form a lid hingedly connected to a base. The separately formed collar is located within the outer carton. The collar includes a front portion and opposing first and second side portions which are adhered to the respective front wall and opposing first and second side walls of the outer carton. To open the carton, the tear strip is removed and the lid is lifted upward relative to the base. To reclose the carton, the lid is pushed back downward to its original position, where the lid is retained either by frictional engagement with the base or by some type of snap closure feature.

Although two-piece containers of the foregoing type can provide excellent functionality if properly manufactured, such two-piece containers generally require more paperboard than one-piece containers. The use of additional paperboard in the two-piece containers increases the cost of manufacturing such containers.

Furthermore, the two-piece containers generally require a high degree of precision during the manufacturing process. To manufacture the two-piece container, the outer carton is formed from a carton blank and the internal collar is formed from a separate collar blank. To form the reclosable container from the carton and collar blanks, the collar blank is glued to the inner surface of the carton blank with the fold lines of the collar blank preferably aligned with corresponding fold lines of the carton blank. The joined carton and collar blanks are then folded in tandem with each other to create the reclosable container. In the above manufacturing process, the joined carton and collar blanks must be properly aligned to assure that the fold lines joining the walls of the outer carton will not crack in response to folding the joined carton and collar blanks in tandem with each other. Moreover, if the container is provided with a snap closure feature for retaining the lid in the closed position, proper alignment of the outer carton and the internal collar assures that the closure feature will function properly.

Accordingly, a need exists for a flip-top reclosable container that overcomes the above-noted shortcomings generally associated with two-piece containers. The present invention effectively and conveniently realizes such a reclosable container.

SUMMARY OF THE INVENTION

A one-piece, flip-top reclosable carton embodying the present invention is comprised of an outer carton and an internal collar. The outer carton includes opposing top and bottom walls, opposing front and back walls, and opposing first and second side walls. The first and second side walls and the front wall include a continuous horizontal tear means for opening up the carton from a sealed form to form a lid hingedly connected to a base. The top wall includes first and second top minor flaps hingedly connected to upper ends of the respective first and second side walls. Prior to initially opening the carton, the internal collar is hingedly connected to the first and second top minor flaps. Opening the carton breaks this hinged connection between the collar and the top minor flaps. The collar is disposed within the carton and includes a front panel and opposing first and second side panels adjacent to the respective front wall and the opposing first and second side walls of the carton. The collar includes at least one hinged portion and at least one island portion disposed in forcibly displaceable mutual engagement such that opening the lid exerts a force which disengages the mutual engagement and closing the lid leads to snap re-engagement of the hinged portion and the island portion.

The flip-top reclosable container described above is formed from a unitary, continuous blank. The blank includes a carton-forming portion and a collar-forming portion. The carton-forming portion includes a plurality of carton panels hingedly connected to each other along vertical fold lines. The carton-forming portion also includes a plurality of top and bottom closure flaps hingedly connected to respective upper and lower ends of the carton panels. The foregoing carton panels and closure flaps of the blank are used to form the corresponding walls of the outer carton of the reclosable container. The collar-forming portion includes a plurality of collar panels hingedly connected to each other along vertical fold lines. The collar panels of the blank are used to form the corresponding panels of the collar of the reclosable container. The collar panels of the blank corresponding to the first and second side panels of the collar are hingedly connected to the respective first and second top minor flaps along horizontal fold lines. The collar-forming portion includes the hinged portion and the island portion described above in connection with the reclosable container.

The one-piece, flip-top reclosable container embodying the present invention is advantageous because it can be produced from less paperboard than typical two-piece, flip-top reclosable cartons. If the collar-forming portion of the blank were removed and a rectangular outline as small as possible were drawn around the carton-forming portion, the collar-forming portion of the blank fits within this rectangular outline. Thus, the blank retains a regular shape even with its incorporation of the collar-forming portion, thereby resulting in a paperboard savings and reducing the cost of manufacturing the container.

In addition, since the internal collar is integrally formed with the outer carton, these two elements will be properly aligned with each other. This proper alignment assures that the fold lines joining the walls of the carton will not crack in response to forming the blank into the reclosable container. Moreover, if the container is provided with a snap closure feature for retaining the lid in the closed position, the proper alignment of the outer carton and the internal collar assures that the closure feature will function properly.

BRIEF DESCRIPTION OF THE DRAWINGS

Other objects and advantages of the invention will become apparent upon reading the following detailed description and upon reference to the drawings in which.

Figure 1:
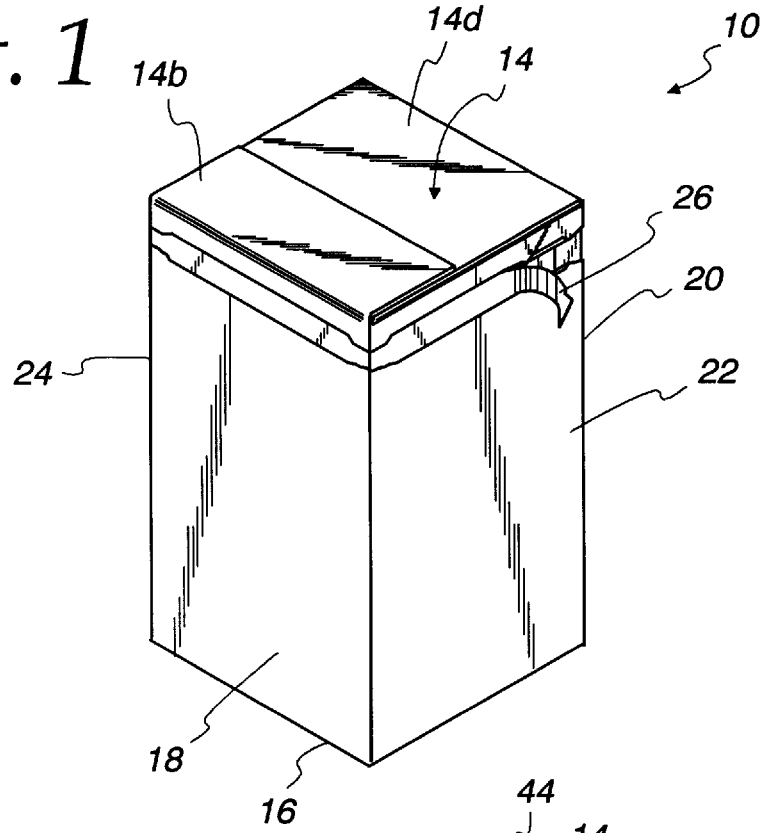
FIG. 1 is an isometric view of a sealed reclosable container in accordance with a first embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
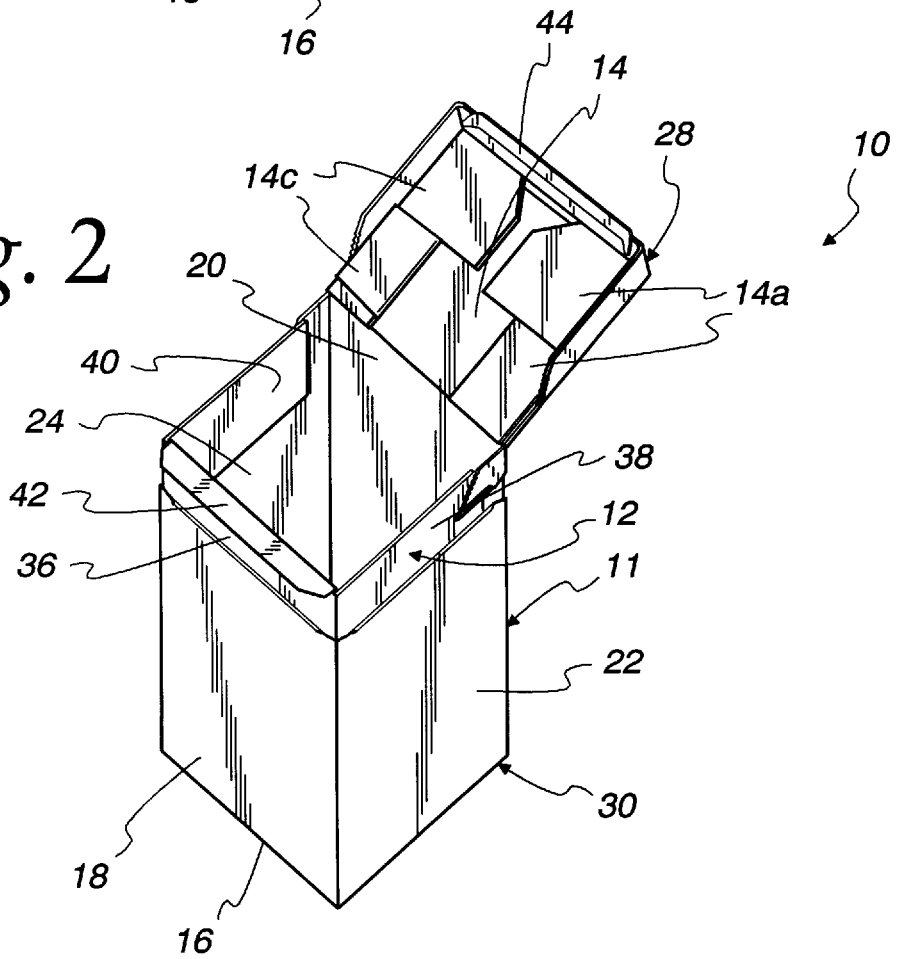
FIG. 2 is an isometric view of the container of FIG. 1 after it has been opened.

Turning now to the drawings, in which analogous items are designated by the same reference numerals, FIGS. 1 and 2 depict a one-piece, flip-top reclosable container 10 embodying the present invention. The container 10 is comprised of an outer carton 11 and an internal collar 12 (FIG. 2). The outer carton 11 includes opposing top and bottom walls 14 and 16, opposing front and back walls 18 and 20, and opposing first and second side walls 22 and 24. The first and second side walls 22 and 24 and the front wall 18 include a continuous horizontal tear strip 26 (FIG. 1) for opening up the carton 11 from a sealed form to form a lid 28 (FIG. 2) hingedly connected to a base 30. The tear strip 26 may be replaced with a tear line or other suitable preferential area of weakness. The top wall 14 includes first and second top minor flaps 14*a* and 14*c* hingedly connected to upper ends of the respective first and second side walls 22 and 24.

The internal collar 12 is integrally formed, by a hinged connection, with the first and second top minor flaps 14*a* and 14*c* of the carton 11. Prior to initially opening the carton 11, the collar 12 is still hingedly connected to the top minor flaps 14*a* and 14*c*. Opening the carton 11 breaks this hinged connection between the collar 12 and the top minor flaps 14*a* and 14*c*. The collar 12 is disposed within the carton 11 and includes a front panel 36 and opposing first and second side panels 38 and 40 adhered to the respective front wall 18 and the opposing first and second side walls 22 and 24 of the carton 11. The collar 12 includes elements for providing the container 10 with a snap closure feature. In the embodiment depicted in FIG. 2, the snap closure feature is located along the front of the container 10.

To create the front snap closure feature in FIG. 2, the collar 12 includes a hinged portion 42 and an island portion 44. Prior to initially opening the lid 28, the island portion 44 is fixedly adhered to an inner surface of the lid 28 and is detachably linked to the hinged portion 42 by weakening nicks. The hinged and island portions 42 and 44 form an extension flap that is more clearly seen in FIG. 3, where the extension flap is designated by the reference numeral 62. After the tear strip 26 is removed, opening the lid 28 exerts a force which disengages the mutual engagement of the hinged and island portions 42 and 44. Specifically, opening the lid 28 breaks the weakening nicks joining the island portion 44 to the hinged portion 42 and, therefore, separates the island portion 44 from the hinged portion 42. The island portion 44 is retained on the lid 28 because of the fixed attachment therebetween. Reclosing the lid 28 leads to snap re-engagement of the hinged portion 42 and the island portion 44.

Figure 3:
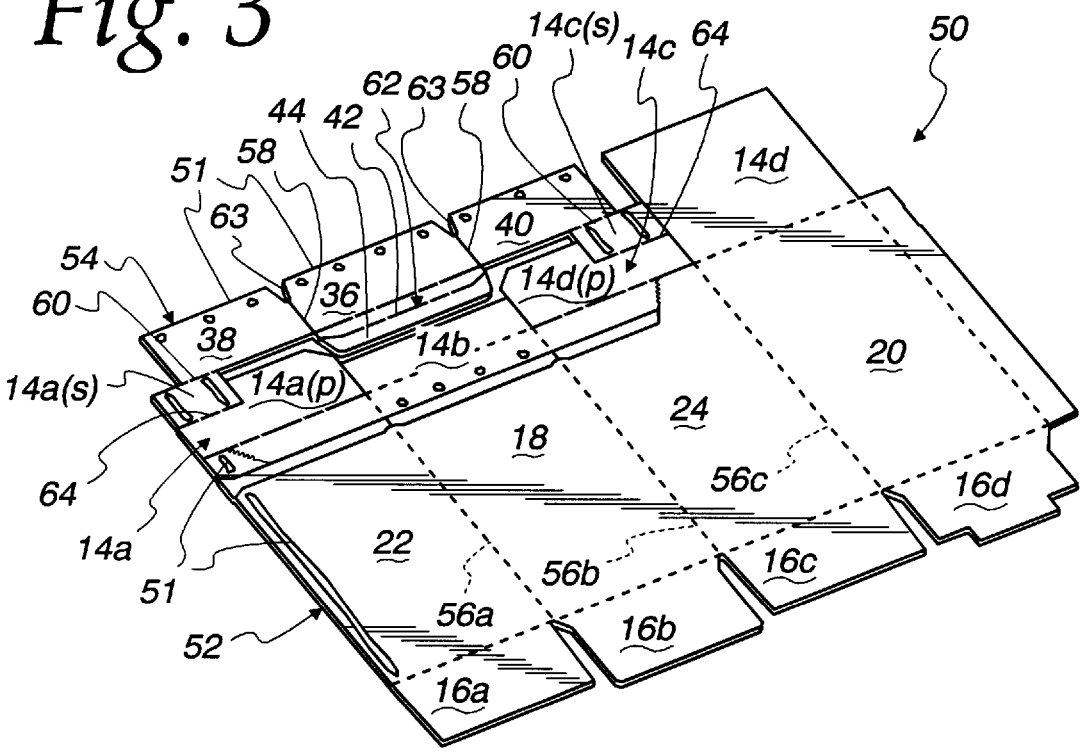
FIG. 3 is an isometric view of a blank used to form the container in FIG. 1.

Referring to FIG. 3, the flip-top reclosable container 10 is formed from a unitary, continuous blank 50 composed of paperboard, cardboard, or the like. FIG. 3 shows an inner surface of the blank 50. The blank 50 includes a carton-forming portion 52 and a collar-forming portion 54. The carton-forming portion 52 is used to form the outer carton 11 in FIG. 2, while the collar-forming portion 54 is used to form the internal collar 12 in FIG. 2.

The carton-forming portion 54 includes a plurality of carton panels 18, 20, 22, and 24 hingedly connected to each other along vertical fold lines 56*a–c*. The carton-forming portion 52 also includes a plurality of top and bottom closure flaps 14*a–d* and 16*a–d* hingedly connected to respective upper and lower ends of the carton panels 18, 20, 22, and 24. The foregoing carton panels and closure flaps of the blank 50 are used to form the corresponding walls of the outer carton 11 of the reclosable container 10.

The top closure flaps 14*a–d*, which form the top wall 14 of the container 10 in FIGS. 1 and 2, include the first and second minor flaps 14*a* and 14*c* and first and second major flaps 14*b* and 14*d*. The minor flap 14*a* includes a primary portion 14*a*(p) and a secondary portion 14*a*(s). The primary portion 14*a*(p) is hingedly connected to the upper end of the side wall panel 22, and the secondary portion 14*a*(s) is in turn hingedly connected to the primary portion 14*a*(p). Likewise, the minor flap 14*c* includes a primary portion 14*c*(p) and a secondary portion 14*c*(s). The primary portion 14*c*(p) is hingedly connected to the upper end of the side wall panel 24, and the secondary portion 14*c*(s) is in turn hingedly connected to the primary portion 14*c*(p). The major flaps 14*b* and 14*d* are hingedly connected to the upper ends of the respective front and back wall panels 18 and 20.

The bottom closure flaps 16*a–d*, which form the bottom wall 16 of the container 10 in FIGS. 1 and 2, include first and second minor flaps 16*a* and 16*c* and first and second major flaps 16*b* and 16*d*. The minor flaps 16*a* and 16*c* are hingedly connected to the lower ends of the respective side wall panels 22 and 24. The major flaps 16*b* and 16*d* are hingedly connected to the lower ends of the respective front and back wall panels 18 and 20.

The collar-forming portion 54 includes a plurality of collar panels 36, 38, and 40 hingedly connected to each other along vertical fold lines 58. The collar panels 36, 38, and 40 of the blank 50 are used to form the corresponding panels of the collar 12 of the reclosable container 10. The side panels 38 and 40 are hingedly connected to the secondary portions of the respective top minor flaps 14*a* and 14*c* along horizontal fold lines 60. This hinged connection joining the side panels 38 and 40 to the secondary portions of the respective top minor flaps 14*a* and 14*c* is temporary because, as stated above, the hinged connection is broken in response to initially opening the completed container from a sealed form. The collar-forming portion 54 includes an extension flap 62 hingedly connected to the front panel 36. The extension flap 62 forms the hinged and island portions 42 and 44 described above in connection with FIGS. 1 and 2. In the blank 50 the hinged and island portions 42 and 44 are detachably linked by weakening nicks.

FIGS. 4–7 depict the sequence of folding and gluing the blank 50 in FIG. 3 to form the reclosable container 10 in FIG. 1. Adhesive applied to the blank 50 for purposes of attaching its folded portions are represented in FIGS. 3–7, as well as the figures associated with the other embodiments of the present invention, by generally circular glue dots and generally straight glue strips. Some of these glue dots and glue strips are designated by the reference numeral 51 in FIG. 3. To relieve stress in the collar-forming portion 54 while folding and gluing the blank 50, the collar-forming portion 54 includes cutout wedges 63 along the vertical fold lines 58. These cutout wedges 63 help to assure that the fold lines 56*a–c* will not crack in response to forming the blank 50 into the reclosable container.

Figure 4:
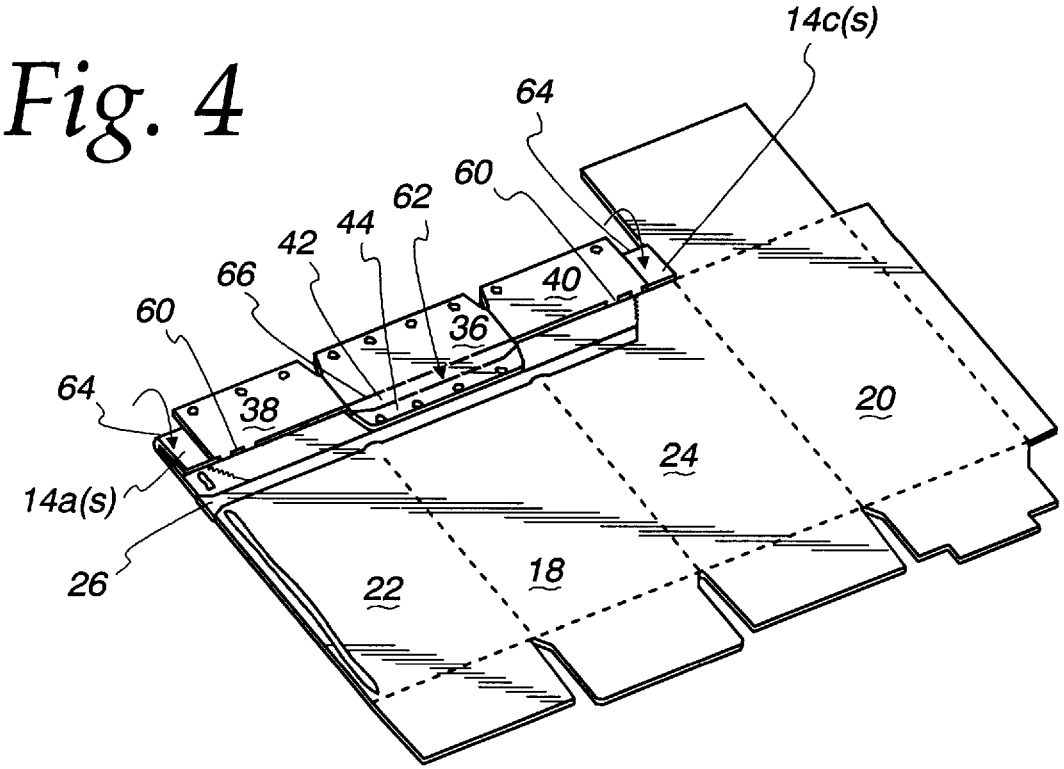
FIGS. 4 and 5 are isometric views of the blank of FIG. 3 after it as been partially folded.

To realize the partially folded blank in FIG. 4 from the unfolded blank 50 in FIG. 3, a Z-type fold is imparted to the blank 50 in FIG. 3 along working fold lines 60 and 64. Specifically, the secondary minor flap portions 14*a*(s) and 14*c*(s) are folded inward approximately 180 degrees relative to the respective primary minor flap portions 14*a*(p) and 14*a*(s) along the working fold lines 64. Simultaneously, the side panels 38 and 40 are folded outward approximately 180 degrees relative to the respective secondary minor flap portions 14*a*(s) and 14*c*(s) along the working fold lines 60. As a result of the above folds, the inner surfaces of the secondary minor flap portions 14*a*(s) and 14*c*(s) are adjacent to the inner surfaces of the respective primary minor flap portions 14*a*(p) and 14*c*(p); the outer surfaces of the side panels 38 and 40 are adjacent to the outer surfaces of the respective secondary minor flap portions 14*a*(s) and 14*c*(s); and the outer surface of the extension flap 62 is adjacent to the inner surface of the front wall panel 18 at a location above the tear strip 26. The inner surfaces of the secondary minor flap portions 14*a*(s) and 14*c*(s) are then adhered to the inner surfaces of the respective primary minor flap portions 14*a*(p) and 14*c*(p). Also, the outer surface of the island portion 44 of the extension flap 62 is adhered to the inner surface of the front wall panel 18.

Figure 5:
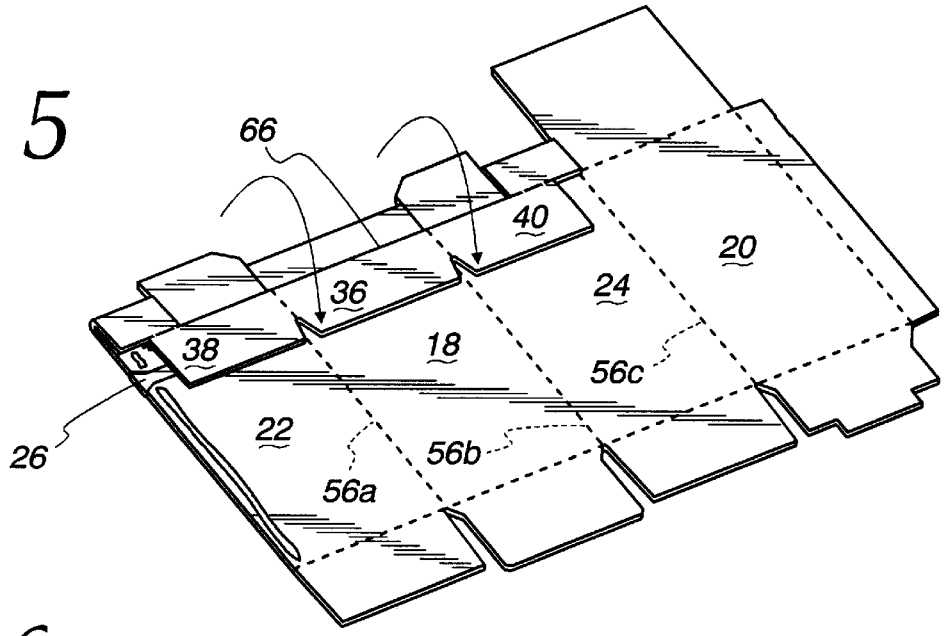

To realize the further folded blank in FIG. 5 from the partially folded blank in FIG. 4, a 180-degree fold is imparted to the blank in FIG. 4 along working fold line 66. Specifically, the collar front panel 36 is folded inward approximately 180 degrees relative to the hinged portion 42 along the working fold line 66. The collar side panels 38 and 40, which are connected to the collar front panel 36, follow the movement of the collar front panel 36. As a result of the above fold, the inner surfaces of the collar side panels 38 and 40 are adjacent to the inner surfaces of the respective carton side wall panels 22 and 24; and the inner surface of the collar front panel 36 is adjacent to the inner surfaces of both the extension flap 62 and the carton front wall panel 18. The inner surfaces of the collar front panel 36 and collar side panels 38 and 40 are then adhered to the inner surfaces of the respective carton front wall panel 18 and carton side wall panels 22 and 24 at locations below the tear strip 26. Such attachment of the collar front panel 36 to the carton front wall panel 18 effectively traps the extension flap 62 between these two attached panels.

Figure 6A:
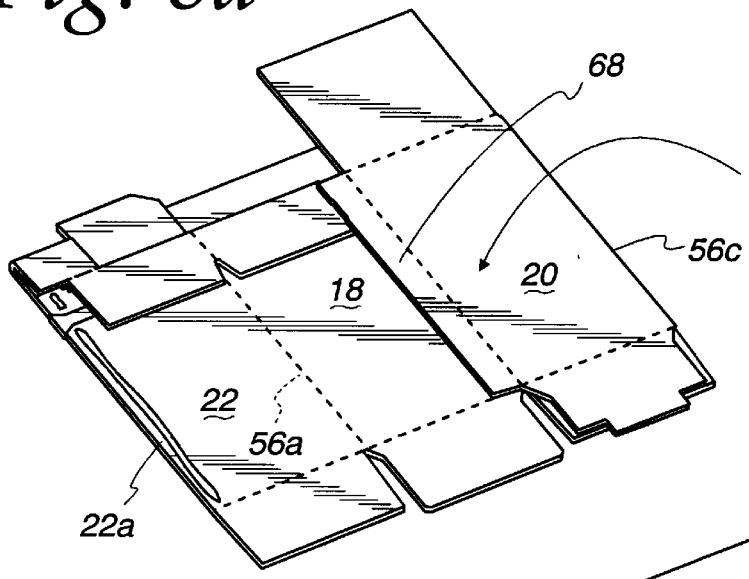
FIGS. 6*a* and 6*b* are isometric views of the blank of FIG. 3 showing the folding and gluing of the blank into a flattened tubular form.
Figure 6B:
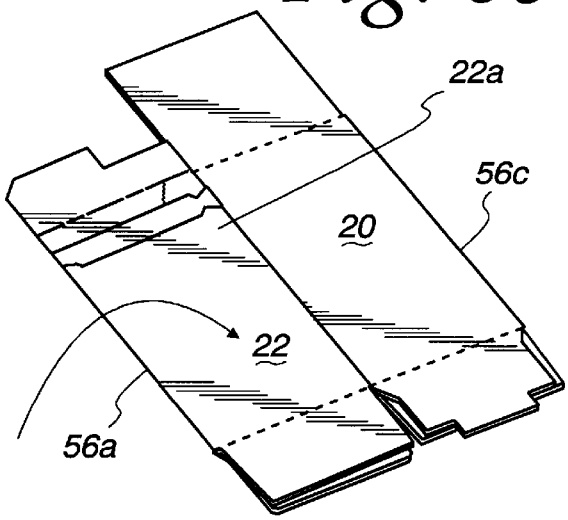

To realize the flattened tubular blank in FIG. 6*b* from the folded blank in FIG. 5, 180-degree folds are successively imparted to the blank along the working fold lines 56*c* and 56*a*. First, the carton back wall panel 20 is folded inward approximately 180 degrees relative to the carton side wall panel 24 along the working fold line 56*c* so that the inner surface of the carton back wall panel 20 is adjacent to the inner surface of the carton side wall panel 24 (FIG. 6*a*). Second, the carton side wall panel 22 is folded inward approximately 180 degrees relative to the carton front wall panel 18 along the working fold line 56*a* so that the inner surface of the carton side wall panel 22 (FIG. 6*b*). As a result of the above fold, most of the inner surface of the carton side wall panel 22 is adjacent to the inner surface of the carton front wall panel 18. However, the inner surface of a strip section 22*a* along the free edge of the carton side wall panel 22 is adjacent to the outer surface of a glue flap 68 hingedly connected to the carton back wall panel 20. This unconnected strip section 22*a* is adhered to the outer surface of the glue flap 68.

Figure 7:
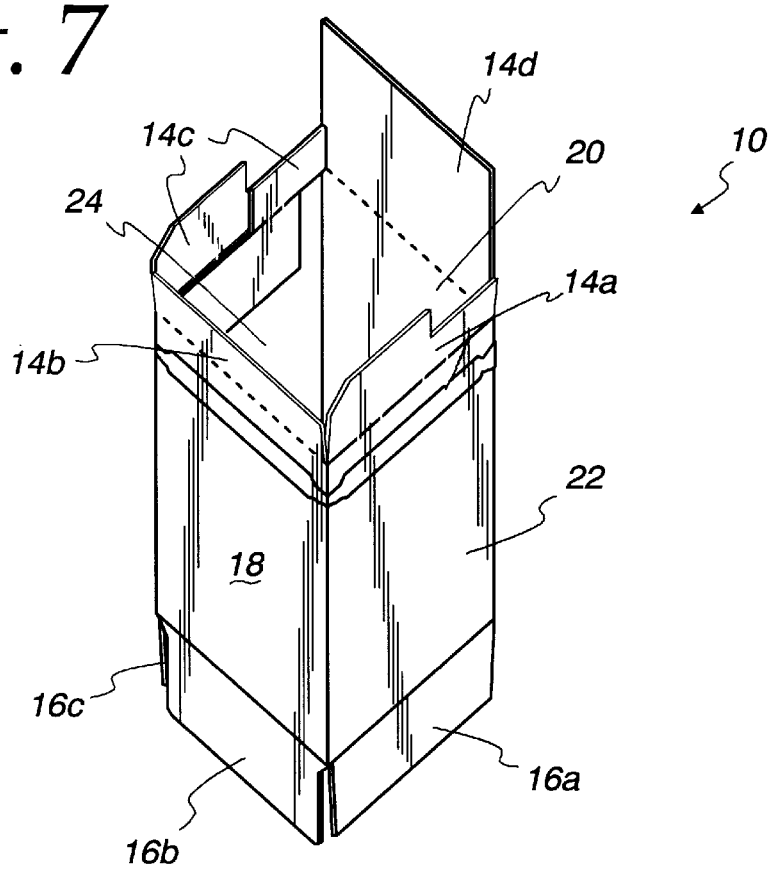
FIG. 7 is an isometric view of the unsealed, erected container of FIG. 1 formed by "popping" open the flattened tubular blank in FIG. 6*b;*

To realize the unsealed, erected container 10 in FIG. 7 from the flattened tubular blank in FIG. 6*b*, opposing inward forces are applied to the working fold lines 56*a* and 56*c* of the flattened blank in FIG. 6*b*. These opposing inward forces cause the flattened blank to "pop" open. The forces are applied for a duration sufficient to form the container 10 into the open rectangular sleeve depicted in FIG. 7.

To realize the sealed container 10 in FIG. 1 from the unsealed, erected container 10 in FIG. 7, the top and bottom closure flaps are folded and glued in conventional fashion to form the top and bottom walls 14 and 16. To form the top wall 14, the top minor flaps 14*a* and 14*c* are first folded inward approximately 90 degrees relative to the respective side walls 22 and 24. The top major flaps 14*d* and 14*b* are then successively folded inward approximately 90 degrees relative to the respective back and front walls 20 and 18. The inner surface of the top major flap 14*b* is adhered to the underlying outer surface of the top major flap 14*d*. The inner surface of the top major flap 14*d* may also be adhered to the underlying outer surfaces of the top minor flaps 14*a* and 14*c*. To form the bottom wall 16, the bottom minor flaps 16*a* and 16*c* are first folded inward approximately 90 degrees relative to the respective side walls 22 and 24. The bottom major flaps 16*d* and 16*b* are then successively folded inward approximately 90 degrees relative to the respective back and front walls 20 and 180 The inner surface of the bottom major flap 16*b* is adhered to the underlying outer surface of the bottom major flap 16*d*. The inner surfaces of the bottom major flaps 16*b* and 16*d* may also be adhered to the underlying outer surfaces of the bottom minor flaps 16*a* and 16*c*. The sealed container 10 resulting from the formation of the top and bottom walls 14 and 16 is depicted in FIG. 1. The sealed container 10 may be opened as shown in FIG. 2 by first removing the tear strip 26 and then lifting the lid 28 upwardly away from base 30.

Figure 8:
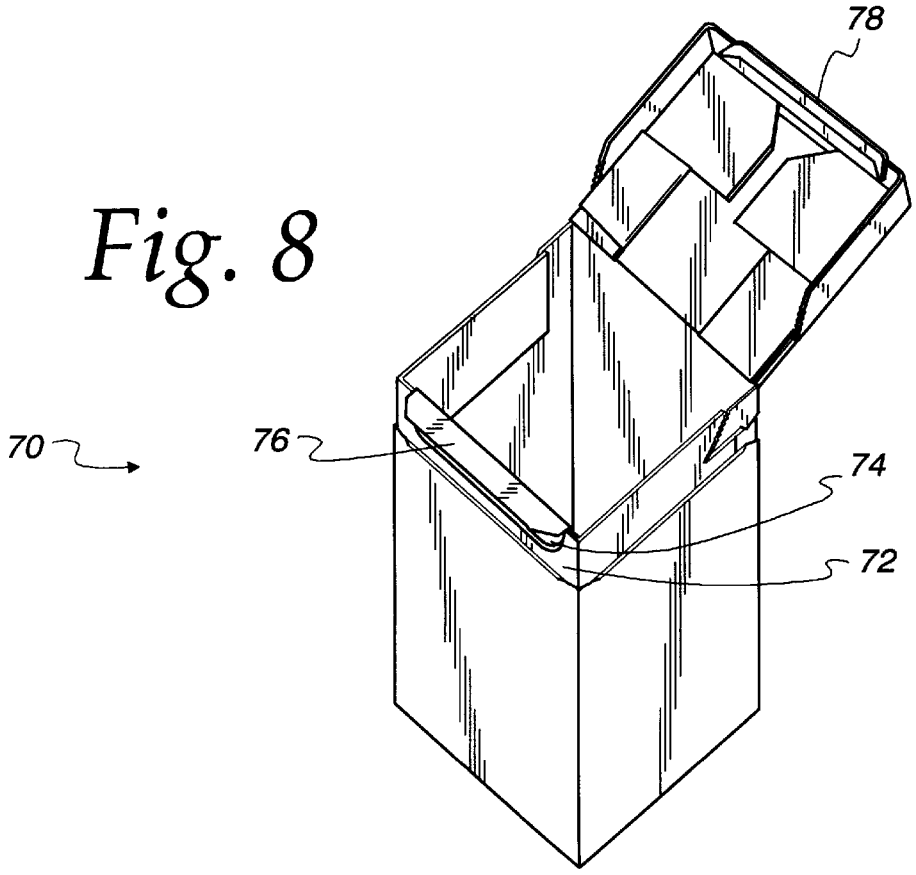
FIG. 8 is an isometric view of an opened reclosable container in accordance with a second embodiment of the present invention.

FIG. 8 depicts an opened reclosable container 70 in accordance with a second embodiment of the present invention. In its sealed form, the container 70 appears like the sealed container 10 in FIG. 1. The container 70 in FIG. 8 and the container 10 in FIGS. 1 and 2 are substantially identical except for the construction of the front snap closure feature. As stated above, the front snap closure feature of the container 10 is formed by an extension flap 62 hingedly connected to the collar front panel 36. This extension flap 62 creates the hinged and island portions 42 and 44. In contrast, the front snap closure feature of the container 70 is formed by the collar front panel 72 and a backboard flap 74. The collar front panel 72 forms the hinged and island portions 76 and 78. The backboard flap 74 is hingedly connected to the collar front panel 72 and, prior to initially opening the lid, overlaps both the hinged and island portions 76 and 78. As seen in the opened container in FIG. 8, the backboard flap 74 is exposed in the area vacated by the island portion 78, which is fixedly attached to the inner surface of the lid. Further details concerning the construction and operation of the front snap closure feature of the container 70 are disclosed in U.S. Pat. Nos. 5,154,343, 5,265,799 and 5,314,114, which are incorporated herein by reference in their entirety.

Figure 9:
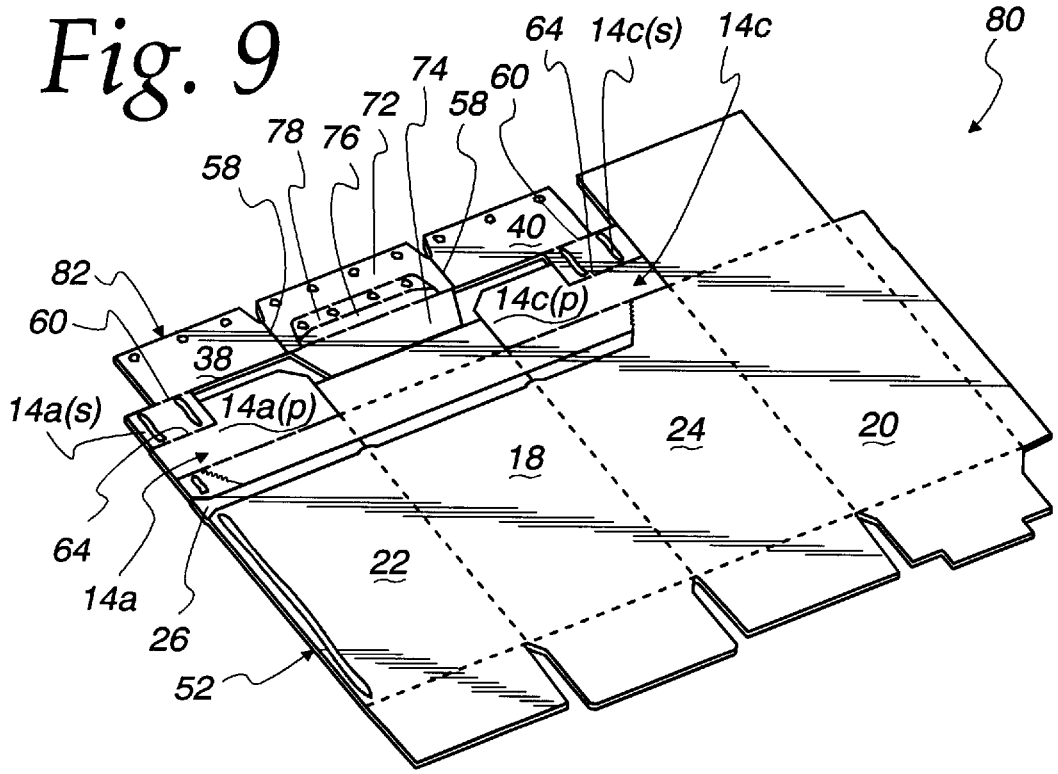
FIG. 9 is an isometric view of a blank used to form the container in FIG. 8.

Referring to FIG. 9, the flip-top reclosable container 70 in FIG. 8 is formed from a unitary, continuous blank 80 having a carton-forming portion 52 and a collar-forming portion 82. As much of the blank 80 is identical to the blank 50 in FIG. 3, the description below focuses on those portions of the blank 80 that are different from the blank 50.

The collar-forming portion 82 of the blank 80 includes a plurality of collar panels 72, 38, and 40 hingedly connected to each other along vertical fold lines 58. The collar panels 72, 38, and 40 of the blank 80 are used to form the corresponding panels of the collar of the reclosable container 70. The side panels 38 and 40 are hingedly connected to the secondary portions of the respective top minor flaps 14*a* and 14*c* along horizontal fold lines 60. As described above in connection with FIG. 8, the front panel 72 forms the hinged and island portions 76 and 78, and the collar-forming portion 82 includes the backboard flap 74 hingedly connected to the front panel 72. The island portion 78 is detachably linked to the hinged portion 76 and other surrounding portions of the front panel 72 by weakening nicks.

FIGS. 10–13 depict the sequence of folding and gluing the blank 80 to form the reclosable container 70 in FIG. 8. To realize the partially folded blank in FIG. 10 from the unfolded blank 80 in FIG. 9, a 180-degree fold is imparted to the blank 80 in FIG. 9 along the working fold lines 64. Specifically, the secondary minor flap portions 14*a*(s) and 14*c*(s) are folded inward approximately 180 degrees relative to the respective primary minor flap portions 14*a*(p) and 14*a*(s) along the working fold lines 64. As a result of the above fold, the inner surfaces of the secondary minor flap portions 14*a*(s) and 14*c*(s) are adjacent to the inner surfaces of the respective primary minor flap portions 14*a*(p) and 14*c*(p); and the inner surfaces of the collar panels 72, 38, and 40 are adjacent to the inner surfaces of the respective carton wall panels 18, 22, and 24. The inner surfaces of the secondary minor flap portions 14*a*(s) and 14*c*(s) are then adhered to the inner surfaces of the respective primary minor flap portions 14*a*(p) and 14*c*(p). Also, the inner surfaces of the collar panels 72, 38, and 40 are adhered to the inner surfaces of the respective carton wall panels 18, 22, and 24 at locations below the tear strip 26. The inner surface of the island portion 78 of the collar front panel 72 is adhered to the inner surface of the front wall panel 18 at a location above the tear strip 26.

Figure 10:
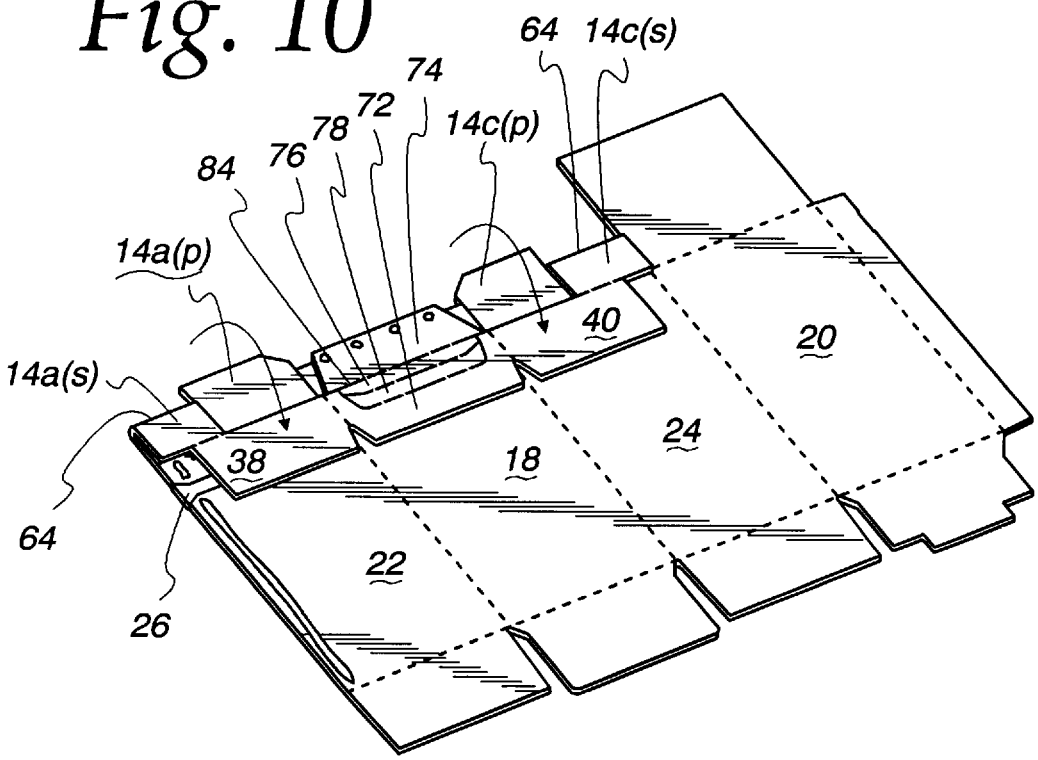
FIGS. 10 and 11 are isometric views of the blank of FIG. 9 after it has been partially folded.
Figure 11:
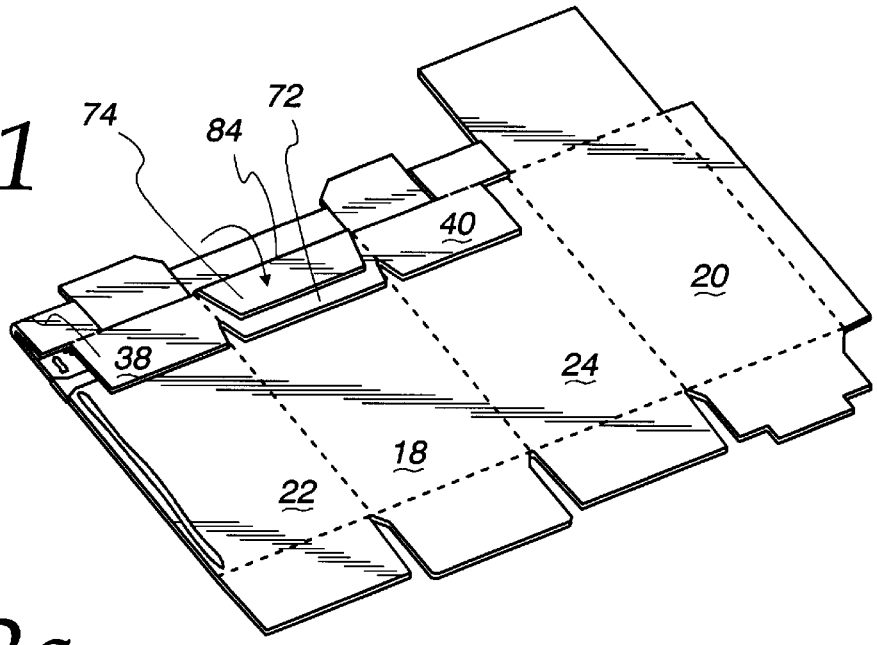

To realize the further folded blank in FIG. 11 from the partially folded blank in FIG. 10, a 180-degree fold is imparted to the blank in FIG. 10 along working fold line 84. Specifically, the backboard flap 74 is folded inward approximately 180 degrees relative to the collar front panel 72 along the working fold line 84. As a result of the above fold, the outer surface of the backboard flap 74 is adjacent to the outer surface of the collar front panel 72. The outer surface of the backboard flap 74 is then adhered to the outer surface of the collar front panel 72 at a location below the hinged and island portions 76 and 78.

Figure 12A:
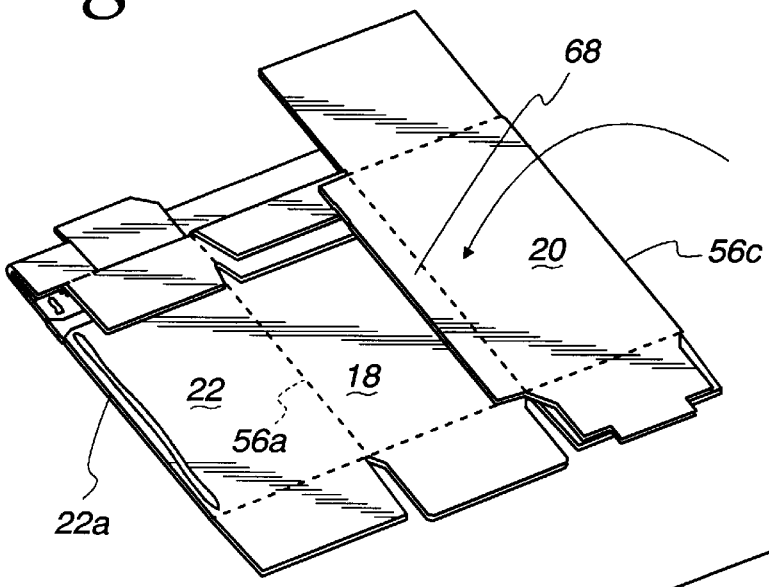
FIGS. 12*a* and 12*b* are isometric views of the blank of FIG. 9 showing the folding and gluing of the blank into a flattened tubular form.
Figure 12B:
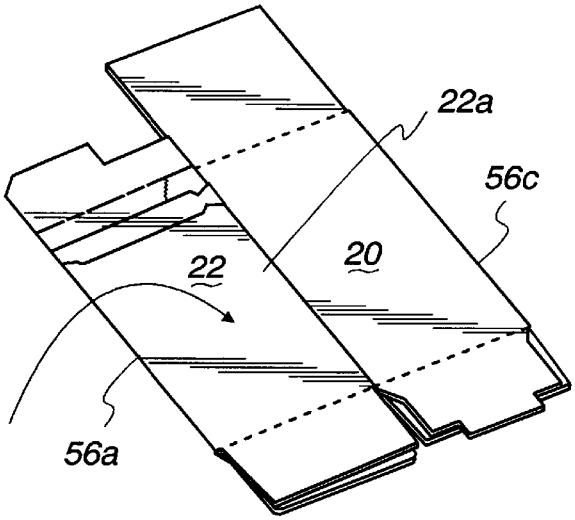
Figure 13:
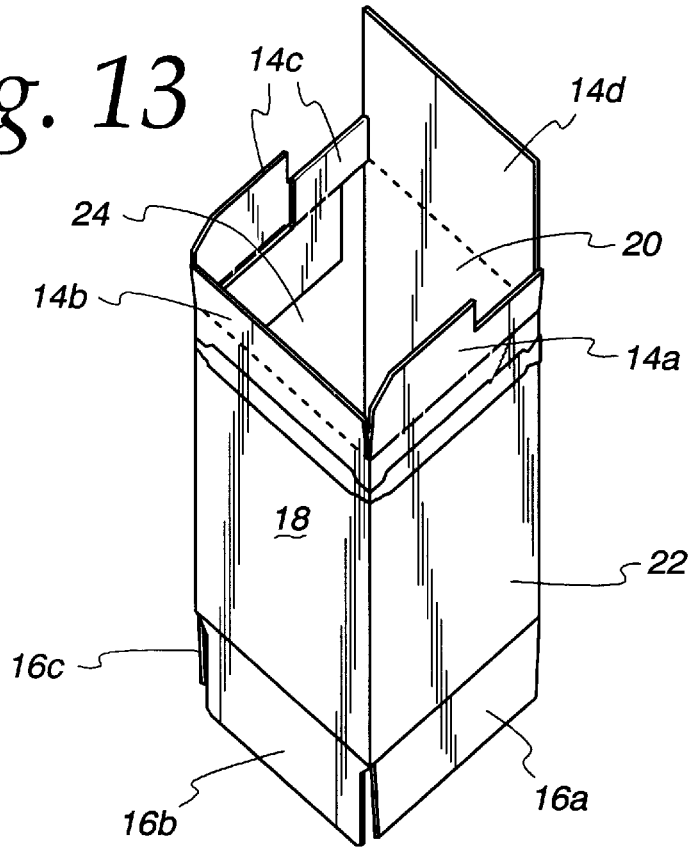
FIG. 13 is an isometric view of the unsealed, erected container of FIG. 8 formed by "popping" open the flattened tubular blank in FIG. 12*b;*

The remaining steps for forming the container 70 from the partially folded blank in FIG. 11 are the same as described above in connection with FIGS. 6*a*, 6*b*, and 7. These steps are illustrated in FIGS. 12*a* and 12*b* (flattened tubular blank) and FIG. 13 (unsealed, erected container). The sealed container 70 resulting from the formation of the top and bottom walls 14 and 16 resembles the container 10 depicted in FIG. 1.

Figure 14:
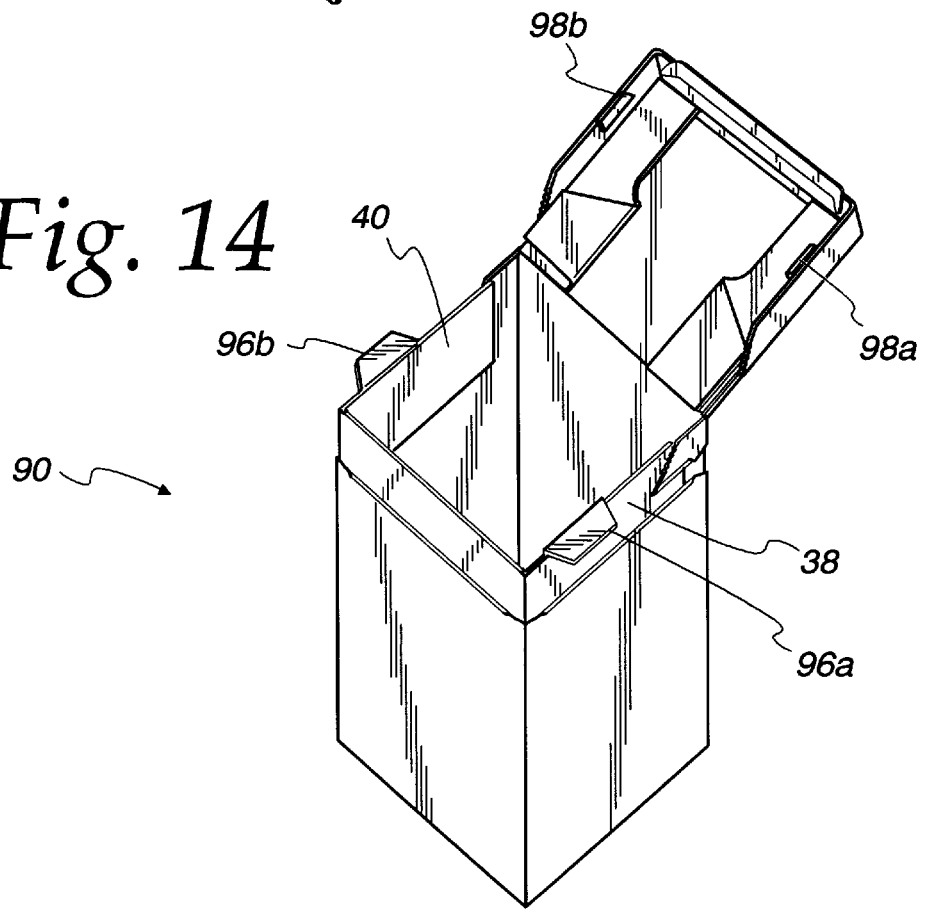
FIG. 14 is an isometric view of an opened reclosable container in accordance with a third embodiment of the present invention.

FIG. 14 depicts an opened reclosable container 90 in accordance with a third embodiment of the present invention. In its sealed form, the container 90 appears like the sealed container 10 in FIG. 1. The container 90 in FIG. 14 and the container 10 in FIGS. 1 and 2 are substantially identical except for the construction of the snap closure feature. As stated above, the snap closure feature of the container 10 is formed by a front extension flap 62 hingedly connected to the collar front panel 36. This extension flap 62 creates the hinged and island portions 42 and 44. In contrast, the snap closure feature of the container 90 is formed by side extension flaps 92 and 94 (see FIG. 15) hingedly connected to the respective collar side panels 38 and 40. The side extension flap 92 forms a first hinged portion 96*a* and a first island portion 98*a*, and, similarly, the side extension flap 94 forms a second hinged portion 96*b* and a second island portion 98*b*. Further details concerning the construction and operation of the side snap closure feature of the container 90 are disclosed in U.S. Pat. No. 5,505,374, which is incorporated herein by reference in its entirety.

Figure 15:
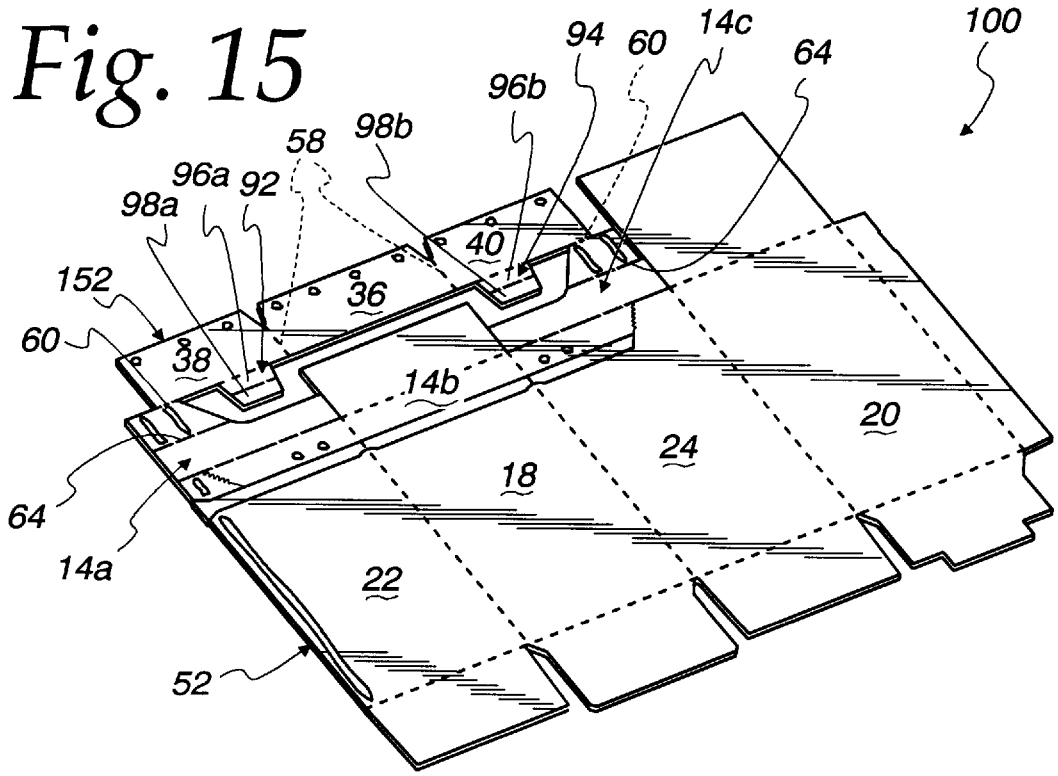
FIG. 15 is an isometric view of a blank used to form the container in FIG. 14.

Referring to FIG. 15, the flip-top reclosable container 90 in FIG. 14 is formed from a unitary, continuous blank 100 having a carton-forming portion 52 and a collar-forming portion 102. As much of the blank 100 is substantially identical to the blank 50 in FIG. 3, the description below focuses on those portions of the blank 100 that are different from the blank 50.

The collar-forming portion 102 of the blank 100 includes a plurality of collar panels 36, 38, and 40 hingedly connected to each other along vertical fold lines 58. The collar panels 36, 38, and 40 of the blank 100 are used to form the corresponding panels of the collar of the reclosable container 90. The side panels 38 and 40 are hingedly connected to the secondary portions of the respective top minor flaps 14*a* and 14*c* along horizontal fold lines 60. As described above in connection with FIG. 14, extension flaps 92 and 94 are hingedly connected to the respective collar side panels 38 and 40. The side extension flap 92 forms the hinged and island portions 96*a* and 98*a*, while the side extension flap 94 forms the hinged and island portions 96*b* and 98*b*. The island portions 98*a* and 98*b* are detachably linked to the respective hinged portions 96*a* and 96*b* by weakening nicks.

FIGS. 16–19 depict the sequence of folding and gluing the blank 100 to form the reclosable container 90 in FIG. 14. To realize the partially folded blank in FIG. 16 from the unfolded blank 100 in FIG. 15, a Z-type fold is imparted to the blank 100 in FIG. 15 along working fold lines 60 and 64 as described above in connection with FIGS. 3 and 4. The outer surfaces of the island portions 98*a* and 98*b* of the respective extension flaps 92 and 94 are adhered to the inner surfaces of the respective side wall panels 22 and 24. Adhesive is applied elsewhere as described above in connection with FIGS. 3 and 4.

Figure 16:
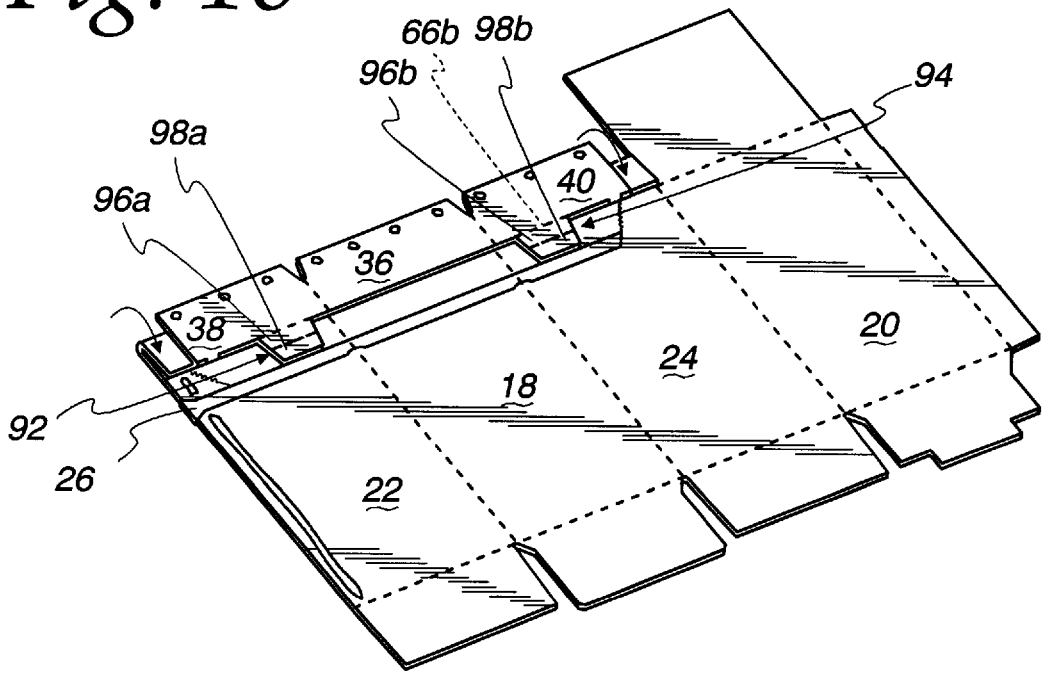
FIGS. 16 and 17 are isometric views of the blank of FIG. 15 after it has been partially folded.
Figure 17:
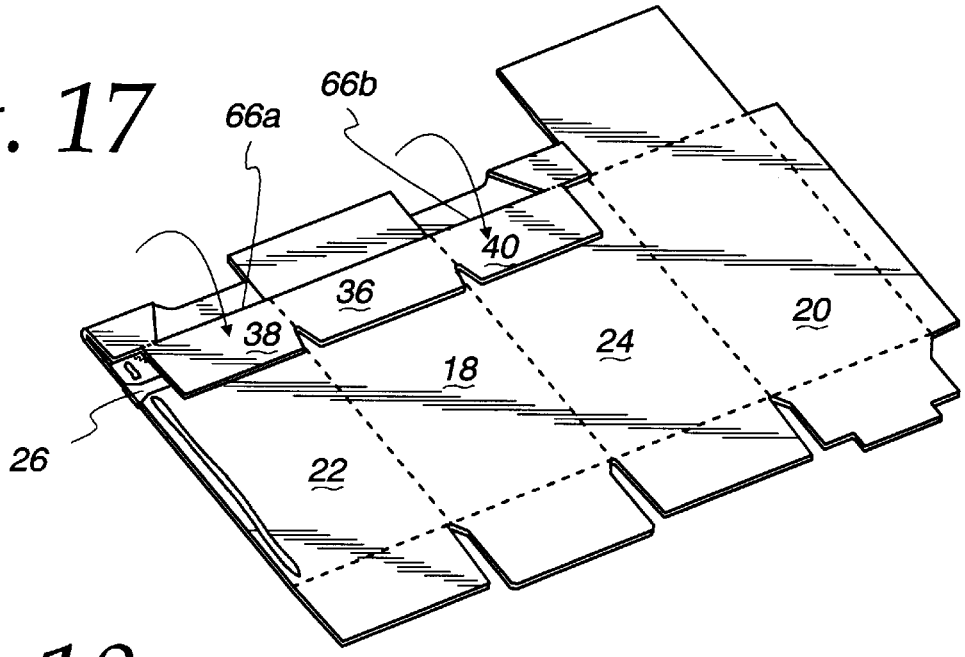

To realize the further folded blank in FIG. 17 from the partially folded blank in FIG. 16, 180-degree folds are imparted to the blank in FIG. 16 along working fold lines 66*a* and 66*b*. Specifically, the collar side panel 38 is folded inward approximately 180 degrees relative to the hinged portion 96*a* along the working fold line 66*a*. Simultaneously, the collar side panel 40 is folded inward approximately 180 degrees relative to the hinged portion 96*b* along the working fold line 66*b*. The collar front panel 36, which is connected to the collar side panels 38 and 40, follows the movement of the collar side panels 38 and 40. As a result of the above fold, the inner surfaces of the collar side panels 38 and 40 are adjacent to the inner surfaces of both the respective extension flaps 92 and 94 and the respective carton side wall panels 22 and 24; and the inner surface of the collar front panel 36 is adjacent to the inner surface of the carton front wall panel 18. The inner surfaces of the collar front panel 36 and collar side panels 38 and 40 are then adhered to the inner surfaces of the respective carton front wall panel 18 and carton side wall panels 22 and 24 at locations below the tear strip 26. Such attachment of the collar side panels 38 and 40 to the respective carton side wall panels 22 and 24 effectively traps the extension flaps 92 and 94 between the respective two attached panels.

Figure 18A:
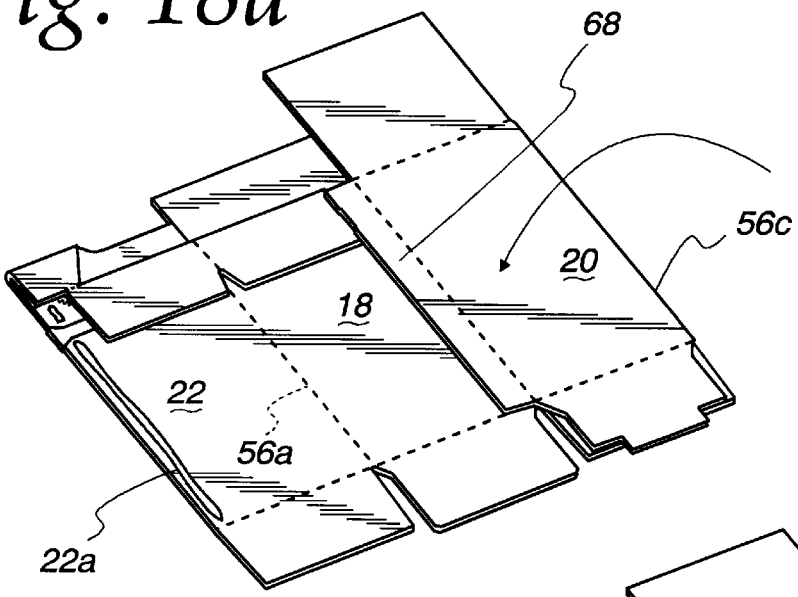
FIGS. 18*a* and 18*b* are isometric views of the blank of FIG. 15 showing the folding and gluing of the blank into a flattened tubular form.
Figure 18B:
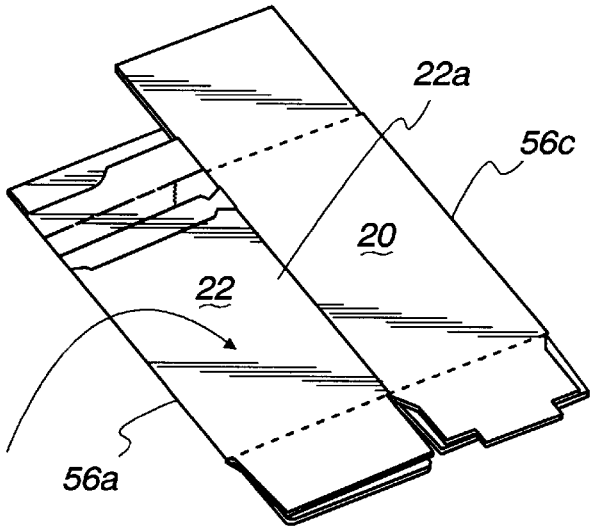
Figure 19:
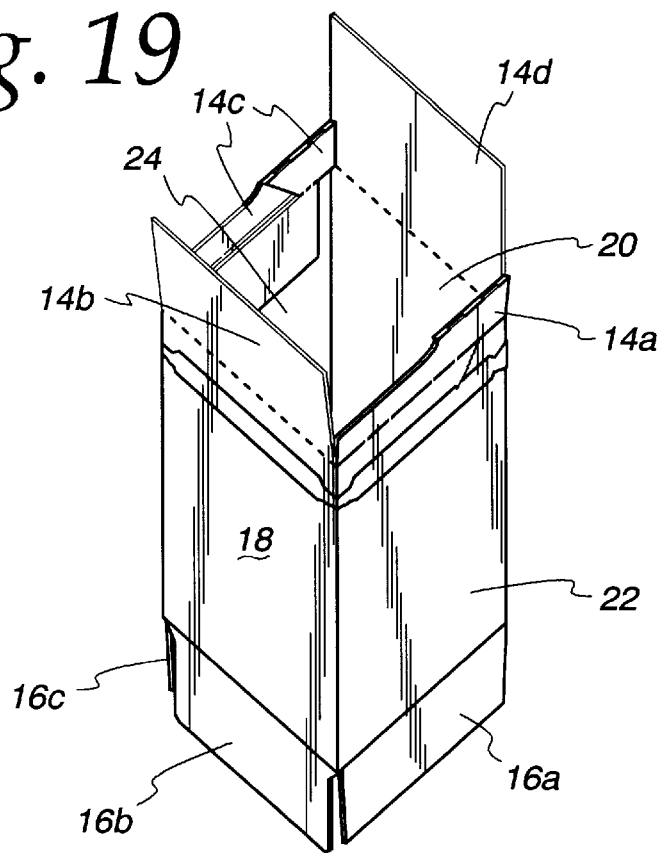
FIG. 19 is an isometric view of the unsealed, erected container of FIG. 14 formed by "popping" open the flattened tubular blank in FIG. 18*b;*

The remaining steps for forming the container 90 from the partially folded blank in FIG. 17 are the same as described above in connection with FIGS. 6*a*, 6*b*, and 7. These steps are illustrated in FIGS. 18*a* and 18*b* (flattened tubular blank) and FIG. 19 (unsealed, erected container). The sealed container 90 resulting from the formation of the top and bottom walls 14 and 16 resembles the container 10 depicted in FIG. 1.

Figure 20:
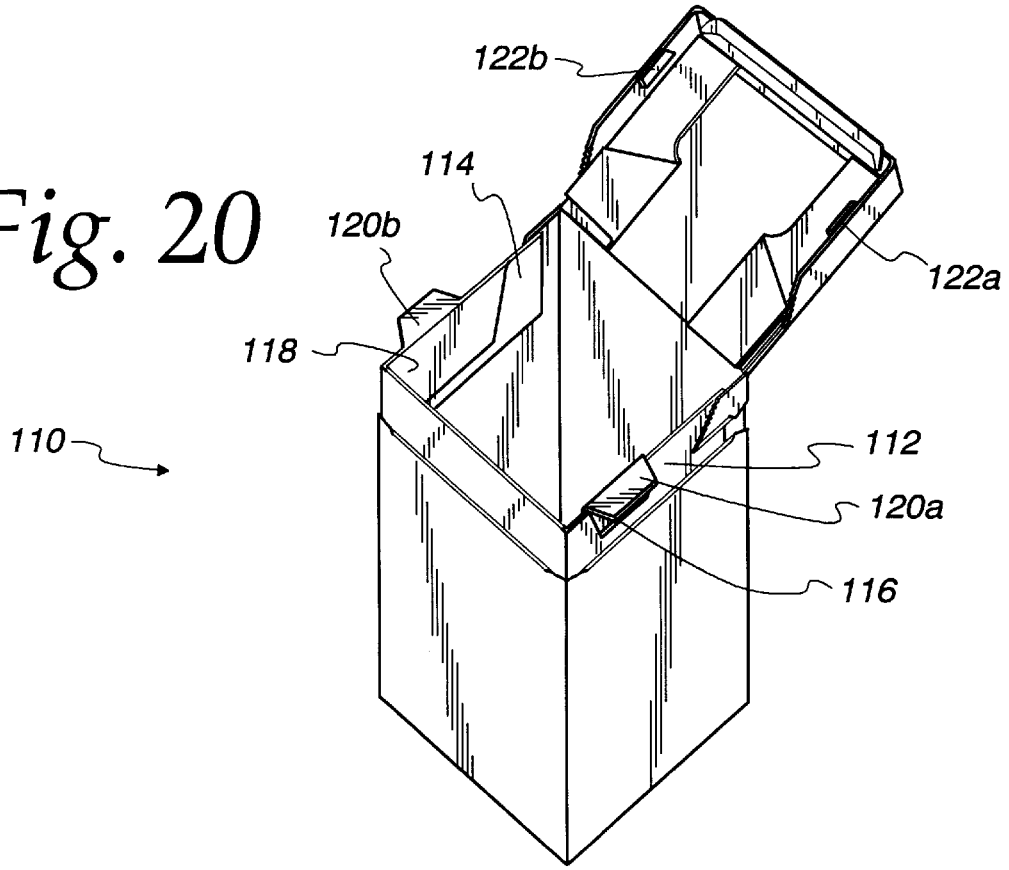
FIG. 20 is an isometric view of an opened reclosable container in accordance with a fourth embodiment of the present invention.

FIG. 20 depicts an opened reclosable container 110 in accordance with a fourth embodiment of the present invention. In its sealed form, the container 110 appears like the sealed container 10 in FIG. 1. The container 110 in FIG. 20 and the container 10 in FIGS. 1 and 2 are substantially identical except for the construction of the snap closure feature. As stated above, the snap closure feature of the container 10 is formed by a front extension flap 62 hingedly connected to the collar front panel 36. This extension flap 62 creates the hinged and island portions 42 and 44. In contrast, the snap closure feature of the container 110 is formed by the collar side panels 112 and 114 and respective backboard flaps 116 and 118. The collar side panel 112 forms a first hinged portion 120*a* and a first island portion 122*a*, and, similarly, the collar side panel 114 forms a second hinged portion 120*b* and a second island portion 122*b*. The backboard flaps 116 and 118 are hingedly connected to the respective collar side panels 112 and 114. Prior to initially opening the lid, the backboard flap 116 overlaps both the hinged and island portions 120*a* and 122*a*, and the backboard flap 118 overlaps both the hinged and island portions 120*b* and 122*b*. After opening the lid, the backboard flaps 116 and 118 are exposed in the areas vacated by the island portions 122*a* and 122*b*, which are fixedly attached to the inner surface of the lid. Further details concerning the construction and operation of the side snap closure feature of the container 110 are disclosed in U.S. Pat. No. 5,505,374.

Figure 21:
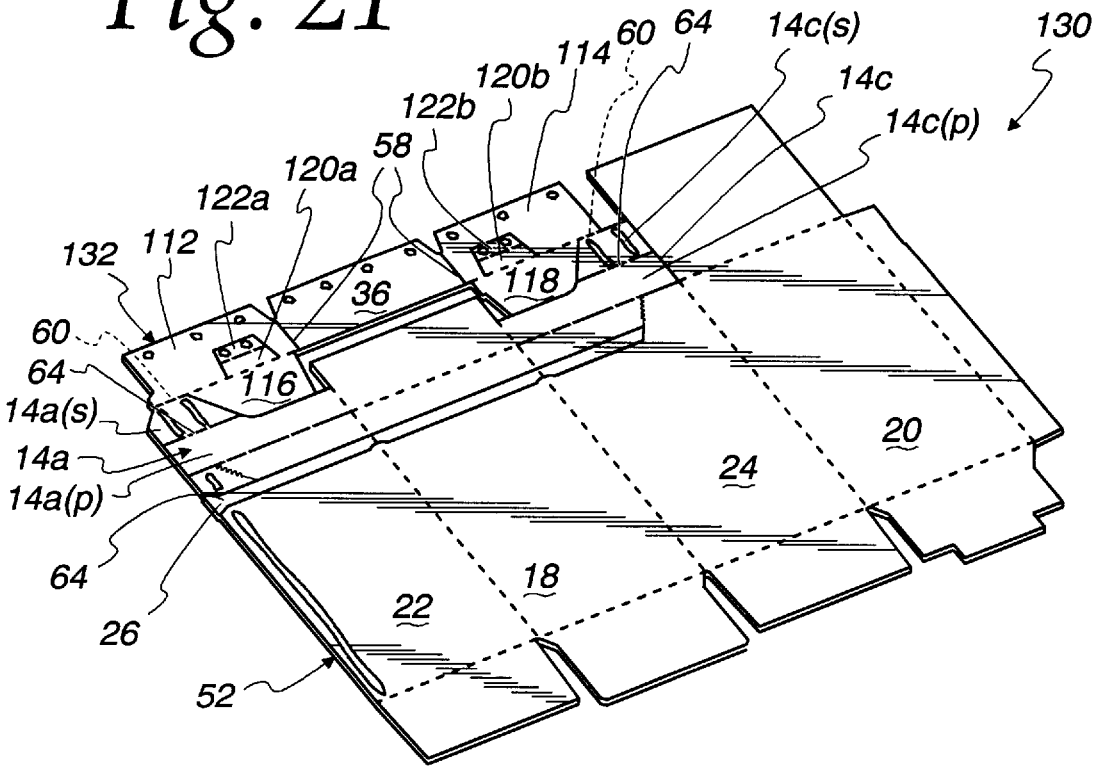
FIG. 21 is an isometric view of a blank used to form the container in FIG. 20.

Referring to FIG. 21, the flip-top reclosable container 110 in FIG. 20 is formed from a unitary, continuous blank 130 having a carton-forming portion 52 and a collar-forming portion 132. As much of the blank 130 is substantially identical to the blank 50 in FIG. 3, the description below focuses on those portions of the blank 130 that are different from the blank 50.

The collar-forming portion 132 of the blank 130 includes a plurality of collar panels 36, 112, and 114 hingedly connected to each other along vertical fold lines 58. The collar panels 36, 112, and 114 of the blank 130 are used to form the corresponding panels of the collar of the reclosable container 110. The side panels 112 and 114 are hingedly connected to the secondary portions of the respective top minor flaps 14*a* and 14*c* along horizontal fold lines 60. As described above in connection with FIG. 20, backboard flaps 116 and 118 are hingedly connected to the respective collar side panels 112 and 114. The collar side panel 112 forms the hinged and island portions 120*a* and 122*a*, while the collar side panel 114 forms the hinged and island portions 120*b* and 122*b*. The island portion 122*a* is detachably linked to the hinged portion 120*a* and other surrounding portions of the side panel 112 by weakening nicks. Likewise, the island portion 122*b* is detachably linked to the hinged portion 120*b* and other surrounding portions of the side panel 114 by weakening nicks.

FIGS. 22–25 depict the sequence of folding and gluing the blank 130 to form the reclosable container 110 in FIG. 20. To realize the partially folded blank in FIG. 22 from the unfolded blank 130 in FIG. 21, a 180-degree fold is imparted to the blank 130 in FIG. 21 along the working fold lines 64. Specifically, the secondary minor flap portions 14*a*(s) and 14*c*(s) are folded inward approximately 180 degrees relative to the respective primary minor flap portions 14*a*(p) and 14*a*(s) along the working fold lines 64. As a result of the above fold, the inner surfaces of the secondary minor flap portions 14*a*(s) and 14*c*(s) are adjacent to the inner surfaces of the respective primary minor flap portions 14*a*(p) and 14*c*(p); and the inner surfaces of the collar panels 36, 112, and 114 are adjacent to the inner surfaces of the respective carton wall panels 18, 22, and 24. The inner surfaces of the secondary minor flap portions 14*a*(s) and 14*c*(s) are then adhered to the inner surfaces of the respective primary minor flap portions 14*a*(p) and 14*c*(p). Also, the inner surfaces of the collar panels 36, 112, and 114 are adhered to the inner surfaces of the respective carton wall panels 18, 22, and 24 at locations below the tear strip 26. The inner surfaces of the island portions 122*a* and 122*b* of the respective collar side panels 112 and 114 are adhered to the inner surfaces of the respective carton side wall panels 22 and 24 at locations above the tear strip 26.

Figure 22:
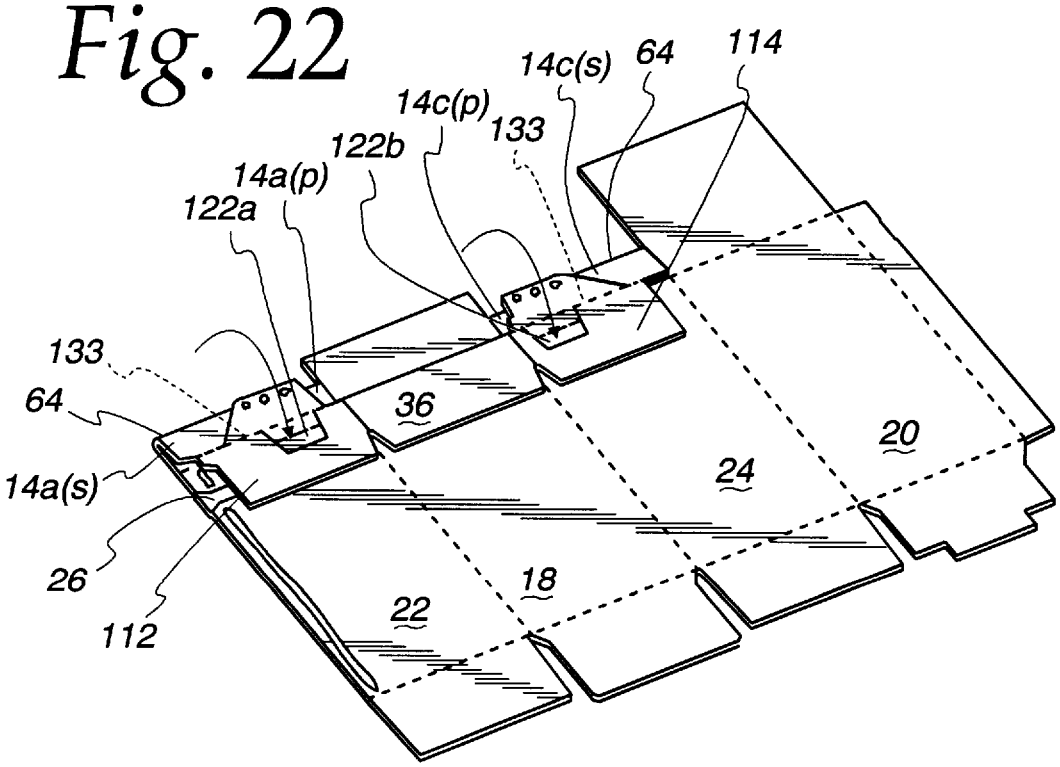
FIGS. 22 and 23 are isometric views of the blank of FIG. 21 after it has been partially folded.
Figure 23:
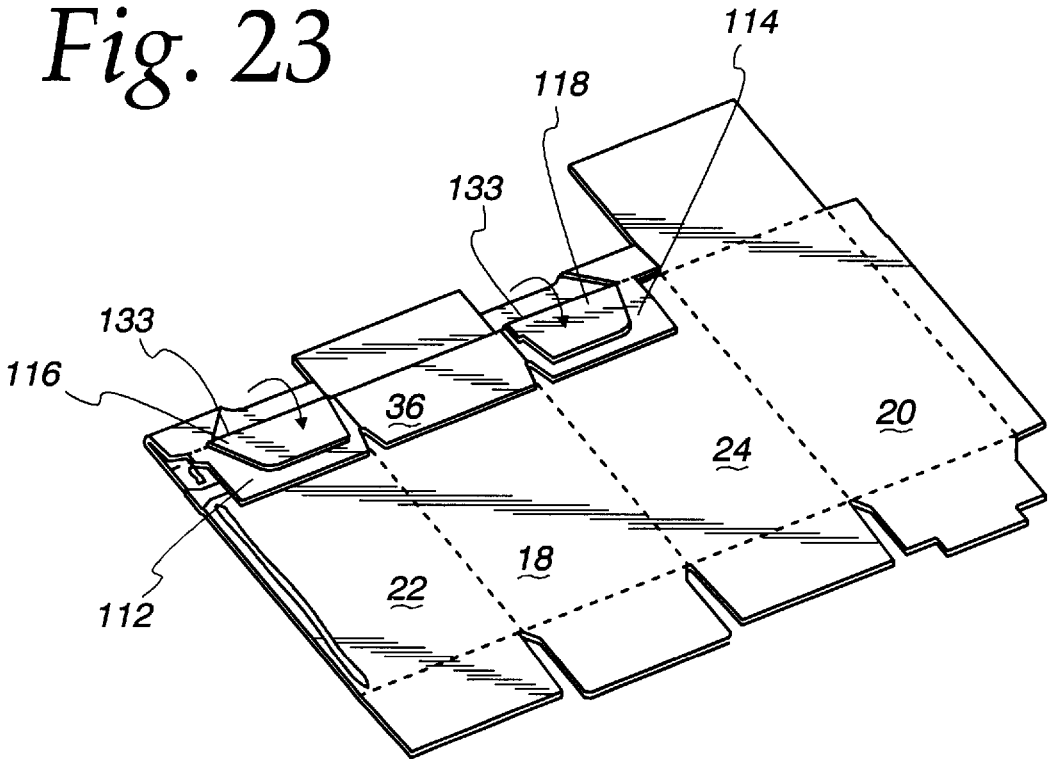

To realize the further folded blank in FIG. 23 from the partially folded blank in FIG. 22, 180-degree folds are imparted to the blank in FIG. 22 along working fold lines 133. Specifically, the backboard flaps 116 and 118 are folded inward approximately 180 degrees relative to the respective collar side panels 112 and 114 along the working fold lines 133. As a result of the above folds, the outer surfaces of the backboard flaps 116 and 118 are adjacent to the outer surfaces of the respective collar side panels 112 and 114. The outer surfaces of the backboard flaps 116 and 118 are then adhered to the outer surfaces of the respective collar side panels 112 and 114 at locations below the associated hinged and island portions.

Figure 24A:
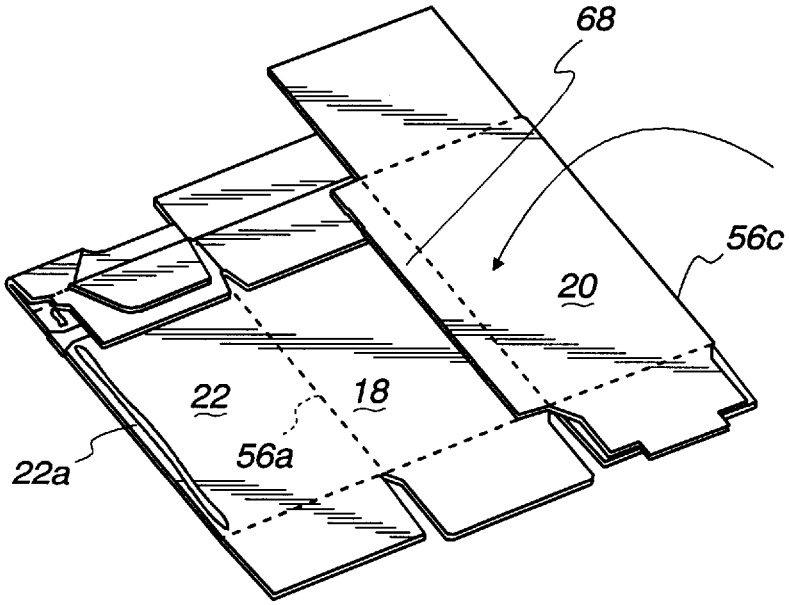
FIGS. 24*a* and 24*b* are isometric views of the blank of FIG. 21 showing the folding and gluing of the blank into a flattened tubular form.
Figure 24B:
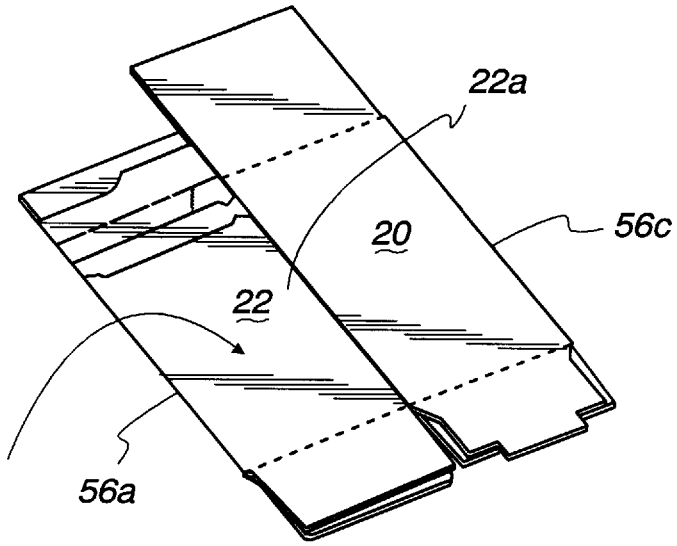
Figure 25:
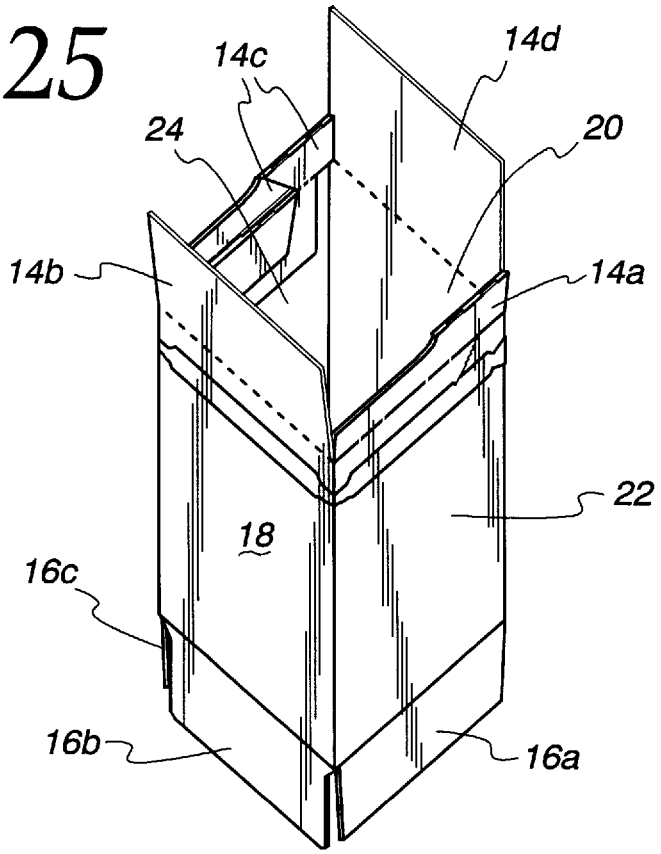
FIG. 25 is an isometric view of the unsealed, erected container of FIG. 20 formed by "popping" open the flattened tubular blank in FIG. 24*b*.

The remaining steps for forming the container 110 from the partially folded blank in FIG. 23 are the same as described above in connection with FIGS. 6*a*, 6*b*, and 7. These steps are illustrated in FIGS. 24*a* and 24*b* (flattened tubular blank) and FIG. 25 (unsealed, erected container). The sealed container 110 resulting from the formation of the top and bottom walls 14 and 16 resembles the container 10 depicted in FIG. 1.

The one-piece, flip-top reclosable containers described above in connection with FIGS. 1–25 are advantageous because they can produced from less paperboard than typical two-piece, flip-top reclosable cartons. If the collar-forming portion of each blank (see FIGS. 3, 9, 15, and 21) were removed and a rectangular outline as small as possible were drawn around the carton-forming portion 52, the collar-forming portion of the blank fits within this rectangular outline. Thus, the blank retains a regular shape even with its incorporation of the collar-forming portion, thereby resulting in a paperboard savings and reducing the cost of manufacturing the container.

In addition, the containers described above in connection with FIGS. 1–25 are advantageous because the hinged connection of the internal collar and the outer carton assures that the internal collar is properly aligned with the outer carton. For example, as shown in FIG. 3, the side panels 38 and 40 of the collar-forming portion 54 of the blank 50 are hingedly connected to the secondary portions of the respective top minor flaps 14*a* and 14*c* of the carton-forming portion 52 along horizontal fold lines 60. The collar-forming portions of the blanks in FIGS. 9, 15, and 21 are hingedly connected in similar fashion to the top minor flaps 14*a* and 14*c* of the carton-forming portion 52. Since the collar-forming portion is hingedly connected to the carton-forming portion 52, these two elements are properly aligned with each other when the collar-forming portion is folded relative to the carton-forming portion 52 and adhered thereto in the manufacturing process (see FIGS. 5, 10, 17, and 22). Specifically, the vertical fold lines 56*a–c* of the carton-forming portion 52 are aligned with the vertical fold lines 58 of the collar-forming portion. This proper alignment assures that the fold lines 56*a–c* will not crack in response to forming the blank into the reclosable container. Moreover, the proper alignment of the outer carton and the internal collar assures that the snap closure feature will function properly.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A flip-top reclosable container comprising:

an outer carton including opposing top and bottom walls, opposing front and back walls, and opposing first and second side walls, said first and second side walls and said front wall including a continuous horizontal tear means for opening up said carton from a sealed form to form a lid hingedly connected to a base, said top wall including first and second top minor flaps hingedly connected to upper ends of said respective first and second side walls; and an internal collar integrally formed with said first and second top minor flaps, said collar disposed within said carton, said collar including a front panel and opposing first and second side panels adjacent to said respective front wall and said opposing first and second side walls of said carton, said collar including at least one hinged portion and at least one island portion disposed in forcibly displaceable mutual engagement such that opening said lid exerts a force which disengages the mutual engagement and closing said lid leads to snap re-engagement of said hinged portion and said island portion.

2. The container of claim 1, wherein said island portion is fixedly attached to an inner surface of said lid and at the same time separatably attached to said hinged portion, wherein opening said lid separates said island portion from said hinged portion while retaining said island portion on said lid.

3. The container of claim 1, wherein said collar includes an extension flap hingedly connected to said front panel, said extension flap forming said island portion and said hinged portion.

4. The container of claim 1, wherein said island portion is fixedly attached to an inner surface of said lid and at the same time separatably attached to said hinged portion, wherein opening said lid separates said island portion from said hinged portion while retaining said island portion on said lid, wherein said collar includes a backboard flap hingedly connected to said front panel and overlapping said hinged portion and said island portion, said front panel forming said island portion and said hinged portion, said backboard flap being exposed in response to opening said lid.

5. The container of claim 1, wherein said at least one hinged portion includes first and second hinged portions and said at least one island portion includes first and second island portions, wherein said collar includes first and second extension flaps hingedly connected to said respective first and second side panels, said first and second extension flaps forming said respective first and second island portions and forming said respective first and second hinged portions.

6. The container of claim 1, wherein said at least one hinged portion includes first and second hinged portions and said at least one island portion includes first and second island portions, wherein said first and second island portions are fixedly attached to an inner surface of said lid and at the same time separatably attached to said respective first and second hinged portions, wherein opening said lid separates said first and second island portions from said respective first and second hinged portions while retaining said island portions on said lid, wherein said collar includes first and second backboard flaps hingedly connected to said respective first and second side panels, said first backboard flap overlapping said first hinged portion and said first island portion, said second backboard flap overlapping said second hinged portion and said second island portion, said first and second side panels forming said respective first and second island portions and forming said respective first and second hinged portions, said backboard flaps being exposed in response to opening said lid.

7. The container of claim 1, wherein said first and second top minor flaps each include an outer primary portion and an inner secondary portion, said secondary portion overlapping and being adhered to said primary portion, said collar being hingedly connected to said secondary portion of each of said top minor flaps.

8. The container of claim 1, wherein said first and second side panels of said collar are hingedly connected to said respective first and second top minor flaps prior to initially opening said lid.

9. The container of claim 1, wherein said collar includes cutout wedges along fold lines joining said front panel to said first and second side panels.

10. The container of claim 1, wherein said front panel and said first and second side panels of said collar are adhered to inner surfaces of said respective front wall and opposing first and second side walls of said carton at locations below said tear means.

11. The container of claim 1, wherein said internal collar is hingedly connected to said first and second top minor flaps prior to initially opening said lid, and wherein opening said lid breaks the hinged connection between said collar and said first and second top minor flaps.

12. A method of manufacturing a flip-top reclosable container, comprising the steps of:

providing a blank including a carton-forming portion and a collar-forming portion, said carton-forming portion having carton front and back wall panels and first and second carton side wall panels hingedly connected to each other along vertical fold lines, said carton-forming portion including a plurality of top and bottom closure flaps hingedly connected to respective upper and lower ends of said carton wall panels, said top closure flaps including first and second top minor flaps, said collar-forming portion including a collar front panel and first and second collar side panels hingedly connected to each other along vertical fold lines, said first and second collar side panels being hingedly connected to said respective first and second top minor flaps along horizontal fold lines, said collar-forming portion including at least one hinged portion and at least one island portion disposed in forcibly displaceable mutual engagement;

folding said blank so that said collar front panel and said opposing first and second collar side panels are adjacent to said respective carton front wall panel and opposing first and second carton side wall panels;

adhering said collar front panel and said opposing first and second collar side panels to said respective carton front wall panel and opposing first and second carton side wall panels;

adhering said island portion to said carton-forming portion; and forming said blank into said reclosable container, said container including an outer carton formed from said carton-forming portion and an internal collar formed from said collar-forming portion.

13. The method of claim 12, wherein said collar-forming portion includes an extension flap hingedly connected to said collar front panel, said extension flap forming said island portion and said hinged portion.

14. The method of claim 12, wherein said collar-forming portion includes a backboard flap hingedly connected to said collar front panel, said collar front panel forming said island portion and said hinged portion.

15. The method of claim 12, wherein said at least one hinged portion includes first and second hinged portions and said at least one island portion includes first and second island portions, wherein said collar-forming portion includes first and second extension flaps hingedly connected to said respective first and second collar side panels, said first and second extension flaps forming said respective first and second island portions and forming said respective first and second hinged portions.

16. The method of claim 12, wherein said at least one hinged portion includes first and second hinged portions and said at least one island portion includes first and second island portions, wherein said collar-forming portion includes first and second backboard flaps hingedly connected to said respective first and second collar side panels, said first and second collar side panels forming said respective first and second island portions and forming said respective first and second hinged portions.

17. The method of claim 12, wherein said first and second top minor flaps each include a primary portion and a secondary portion, said collar-forming portion being hingedly connected to said secondary portion of each of said top minor flaps.

18. The method of claim 14, further including the step of folding said backboard flap relative to said collar front panel such that said backboard flap overlaps said hinged portion and said island portion.

19. The method of claim 16, further including the step of folding said first and second backboard flaps relative to said respective first and second collar side panels such that said first backboard flap overlaps said first hinged portion and said first island portion and said second backboard flap overlaps said second hinged portion and said second island portion.

20. The method of claim 17, further including the steps of folding said secondary portion of each of said top minor flaps relative to said primary portion such that said secondary portion overlaps said primary portion and adhering said secondary portion to said primary portion.

21. The container of claim 12, wherein said collar-forming portion includes cutout wedges along said vertical fold lines joining said collar front panel to said first and second collar side panels.

* * * * *